United States Patent [19]

Kushner et al.

[11] Patent Number: 4,640,105

[45] Date of Patent: Feb. 3, 1987

[54] AUTOMATIC WASHER SUSPENSION SYSTEM

[75] Inventors: Gerald J. Kushner, Louisville, Ky.; Daniel N. Toma, Georgetown, Ind.

[73] Assignee: General Electric Company, Louisville, Ky.

[21] Appl. No.: 760,350

[22] Filed: Jul. 29, 1985

[51] Int. Cl.[4] ..... D06F 37/24

[52] U.S. Cl. ..... 68/23.3; 68/23 R; 248/626; 248/638; 210/363

[58] Field of Search ..... 68/23.1, 23.2, 23.3; 248/638, 626; 210/363; 494/82, 84

[56] References Cited

U.S. PATENT DOCUMENTS

| | | | |
|---|---|---|---|
| 2,300,421 | 11/1942 | Henderson | 68/12 |
| 2,313,928 | 3/1943 | Dyer | 68/23.3 |
| 2,454,112 | 11/1948 | Woodson | 68/23.3 X |
| 2,583,579 | 1/1952 | Lodge | 210/63 |
| 2,658,372 | 11/1953 | Kirby | 68/23 |
| 2,707,088 | 4/1955 | Shelton et al. | 248/638 X |
| 2,748,945 | 6/1956 | Lodge | 210/72 |
| 2,797,569 | 7/1957 | Kirby | 68/23 |
| 3,363,772 | 1/1968 | Jarvis | 68/23.3 X |
| 3,373,961 | 3/1968 | Long | 248/18 |
| 3,556,446 | 1/1971 | Bochan | 248/638 |
| 3,744,746 | 7/1973 | Weir et al. | 248/18 |
| 3,939,674 | 2/1976 | Czech et al. | 68/23.3 |
| 3,958,433 | 5/1976 | Bochan | 68/23.3 |
| 4,341,342 | 7/1982 | Hara | 494/84 X |
| 4,468,938 | 9/1984 | McMillian | 68/23.3 |

FOREIGN PATENT DOCUMENTS

| | | | |
|---|---|---|---|
| 1418762 | 10/1965 | France | 68/23.1 |

*Primary Examiner*—Harvey C. Hornsby
*Assistant Examiner*—Frankie L. Stinson
*Attorney, Agent, or Firm*—Frank P. Giacalone; Radford M. Reams

[57] ABSTRACT

This invention relates to centrifuging machines, and more particularly to vertical axis washing machines, wherein improved vibration-isolating devices are provided to prevent unbalance-caused vibrations of the movable mass from being transmitted to the support structure of the machine to the extent that damage to or "walking" of the machine may occur.

A suspension system is provided for suspending the movable mass above the machine support structure. The suspension system is formed by a plurality of circumferentially spaced spring members supported at the lower ends to the support structure. The springs are connected at their upper ends to a support member. The suspension system for supporting the movable mass on the support member includes a plurality of circumferentially spaced links which extend in the general direction of the vertical axis. Each of the links has one of its ends connected to the support member and the other lower end connected to the movable mass so that the movable mass is supported above the base in a manner which absorb both vertical and horizontal vibrations, and is essentially self-correcting.

14 Claims, 6 Drawing Figures

AUTOMATIC WASHER SUSPENSION SYSTEM

BACKGROUND OF THE INVENTION

This invention relates to vibration isolating systems, and more particularly to a suspension system for isolating vibrations of a moving system from the frame on which it is supported.

The problem of isolating vibrations of moving parts has long been recognized, and many solutions have been proposed therefor. While many of the systems which have been evolved have been satisfactory, it has been found most difficult to provide an arrangement which, together with the eliminatioin of undesirable vibrations in the supporting framework of the apparatus, is also economical while at the same time restricting the vibrational movement of the apparatus to a reasonable extent. In addition, it frequently occurs that the moving parts of such apparatus must often be allowed only a certain number of degrees of freedom, and there is thus the problem of absorbing the vibrations between the moving system and the frame while retaining the motion of the moving system within the predetermined limits established usually by the outer cabinet.

As an example of the problems encountered along this line, most automatic washing machines of this type presently commercially available for domestic use provide a clothes basket in which the clothes are washed and rinsed, and when it is desired to remove the liquid from the clothes the basket is rotated at a high speed so as to centrifuge the liquid out of the clothes. Very often, the system for effecting the washing and centrifuging operations does not have its weight symmetrically distributed about the axis of rotation so that there is inherently an unbalance in the system. In addition, the clothes which are being laundered most often will not distribute themselves perfectly about the inner surface of the cylindrical wall of the basket but will provide an additional degree of unbalance. There is the further consideratioin that vibration-caused motion of the moving system must be maintained within reasonable limits, usually on the basis that the supporting frame or cabinet of the machine must be small enough to be commercially attractive for home usage. Yet a further item for consideration is that vertical axis washing machines, that is, washing machines of the type with a basket, open at its top and reached through a lid in the top of the machine, generally should have a highly limited amount of vertical freedom, both from proper functioning of the apparatus itself and again because of the restrictions on size inherent in an appliance which is to be used in the space normally available in most homes.

SUMMARY OF THE INVENTION

It is therefore an object of the invention to provide an improved system which will be simple in structure and economical to manufacture, yet which will effectively prevent the vibratioins of the moving system from reaching the stationary part of the apparatus in which the moving system is included.

A more specific object of the invention is to provide a vibration isolating system wherein all degrees of freedom of movement are provided including both vertical and horizontal while at the same time insuring that the node while allowed to move both vertically and horizontally will remain below movable mass.

In one aspect of the invention there is provided in a vertical axis washing machine a cabinet including a base, a movable mass, a rotatable basket and means for imparting oscillation and rotation to the movable mass, and a suspension system for suspending the movable mass within the cabinet and above a base.

The suspension system is formed to include a plurality of circumferentially spaced spring members. The springs are secured at their lower end to the base of the machine and at their upper end are joined to a support member. A plurality of circumferentially spaced links are provided which extend in the general direction of the vertical axis. Each of the links has one of its ends connected to the support member with its other ends connected to the movable mass. The dimension of the spring members and links are such that the movable mass is supported both for vertical and horizontal movement above the base so as to be self-correcting.

DESCRIPTION OF THE PREFERRED EMBODIMENT

Figure 1:
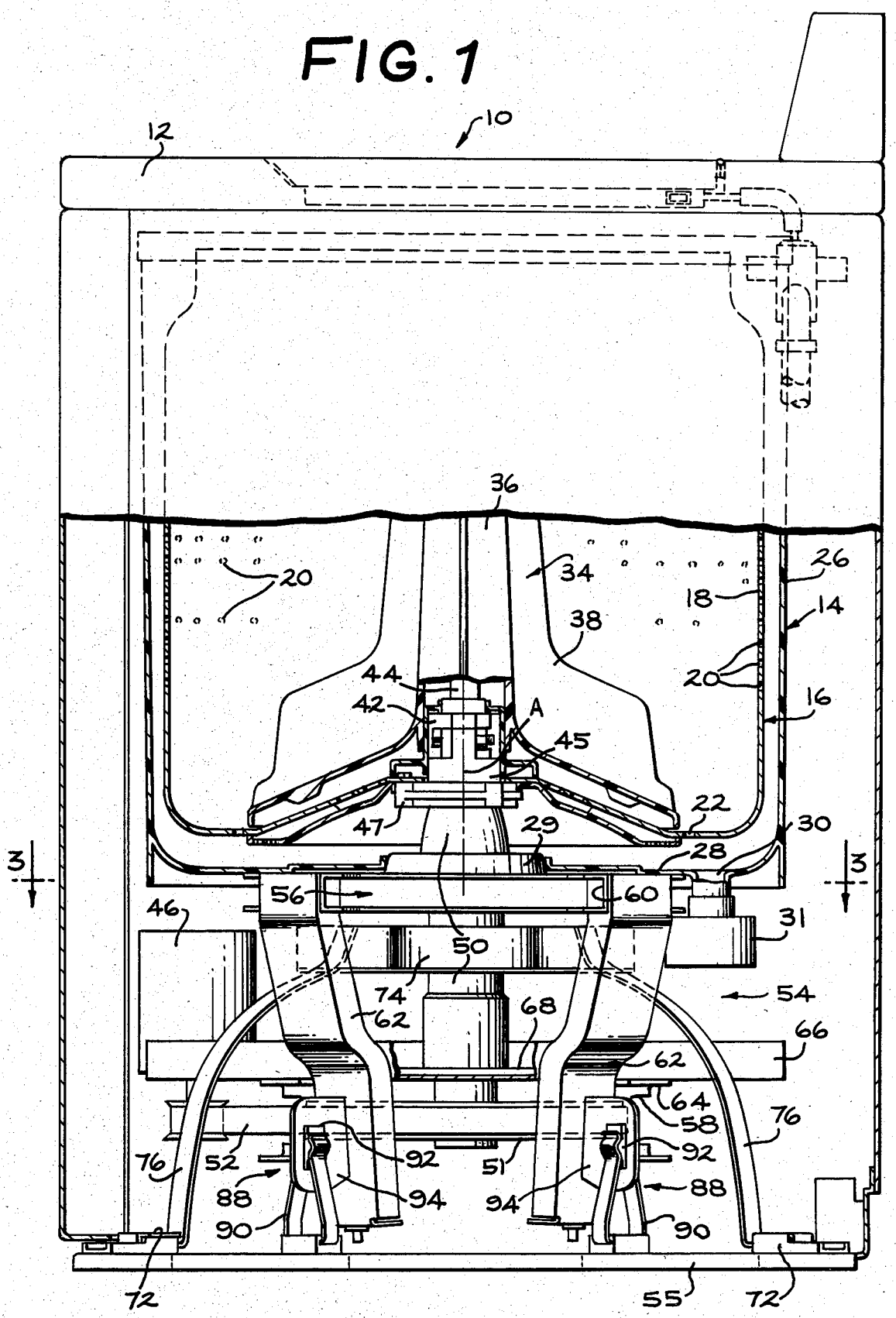
FIG. 1 is an elevational view in section of a washing machine incorporating the suspension system of the present invention.

Referring to FIG. 1, there is shown a washing machine 10 of the vertical axis type which includes a cabinet 12. Within the cabinet 12 is disposed an imperforate tub 14. Within the imperforate tub 14 there is disposed a basket 16 for receiving fabric articles, such as clothing to be washed. The basket side wall 18 includes a plurality of apertures 20 for discharge of water during a centrifugal extraction portion of the operating cycle of the machine. The bottom wall 22 of basket 16 slopes upwardly from a low portion at the outer circumference of the side wall 18 toward the central vertical axis designated by the letter "A" in the drawings. The tub 14 is composed of an imperforate side wall 26 and a generally imperforate and substantially horizontally disposed bottom wall 28 having a single drain opening 30. The tub 14 is mounted on a stationary support flange 29 arranged on the vertical axis. At the center of the basket 16 there is positioned a vertical axis agitator 34 which includes a vertical center post 36 and a plurality of vanes 38 extending outwardly from the central post 36 thereof. The agitator vertical center portion 36 is concentrically mounted above a center post 42, and is driven by an oscillating agitator drive shaft 44, by means of a drive motor 46.

The basket 16 is mounted on a flange 47 of a rotatable spin hub 45. During operation of the washing machine in the washing cycle, the agitator 34 driven by shaft 44 is first oscillated back and forth within the basket 16 to wash the clothes therein. Then, after a predetermined period of this washing action, the basket 16 driven by spin hub 45 is rotated at high speed to extract centrifugally the washing liquid and discharge it through apertures 20 into the outer tub 14 for draining from the machine through drain opening 30. Liquid from the drain 30 is carried from the machine by a pump 31 which may be energized during the extraction operation or a selected portion thereof. The above described cycle may be repeated in carrying out a wash operation depending on the fabric to be washed. The basket 16 and agitator 34 may be driven by any suitable means as the drive means forms no part of the present invention. However, by way of example, they are shown as driven by an electrically commutated reversible motor 46.

The shaft 44 and the enclosing vertical sleeve 50 extend a substantial distance below the tub 14 to a driving mechanism including a pulley 51 driven by a belt 52 passing over the output shaft of the electrical motor 46. The machine so far described will hereinafter be designated as the movable mass which is carried on a chassis or suspension system generally designated at 54.

The suspension system 54 is formed to include a frame portion or structure fixedly secured to the operating components of the washing machine or movable mass, and a supporting portion secured to the base 55. The portion secured to the movable mass includes an upper frame 56 on which the tub 14 is supported, and a lower frame 58 on which the motor 46 and lower portion of the sleeve 50 is supported.

Figure 2:
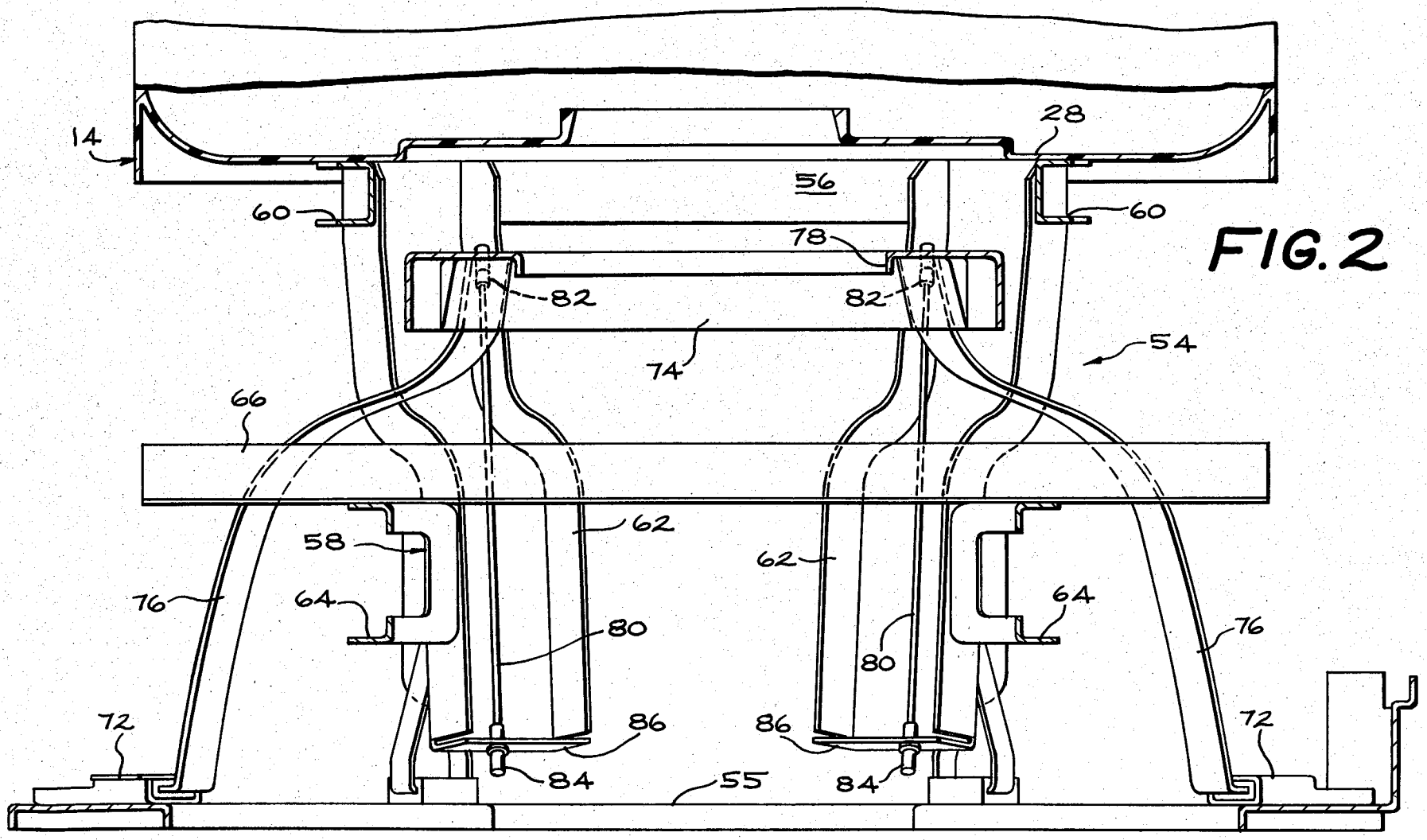
FIG. 2 is an enlarged elevational view in cross section showing details of the suspension system.
Figure 3:
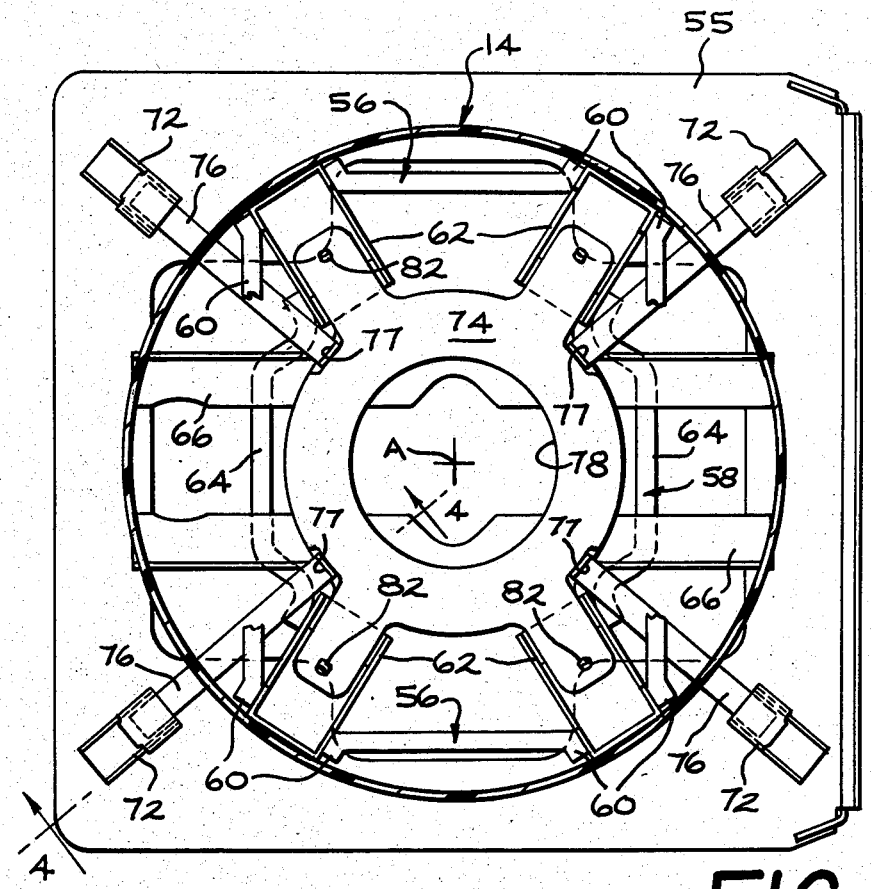
FIG. 3 is a plan view of the suspension system taken along line 3—3 of FIG. 1.
Figure 5:
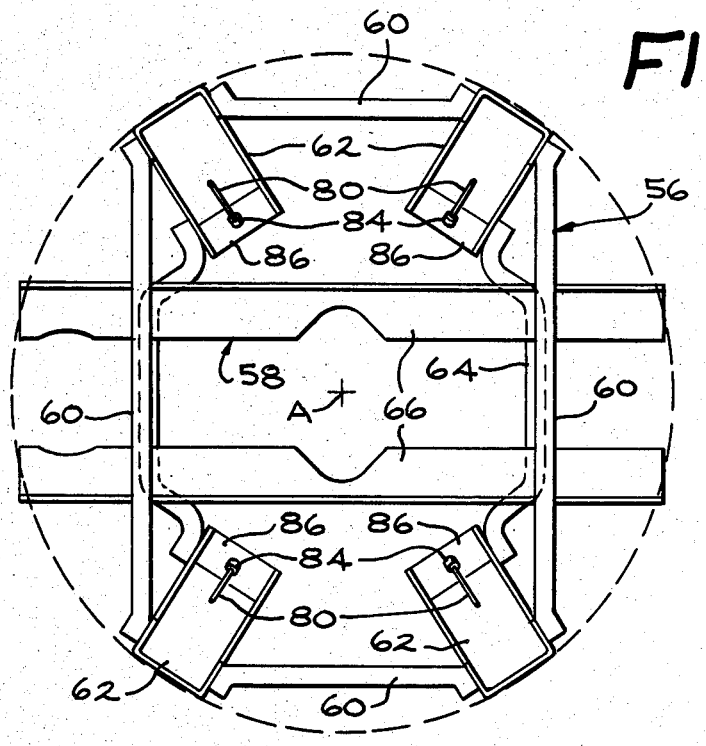
FIG. 5 is a plan view of a portion of the suspension system secured to the movable mass of the machine.

The upper frame 56 as shown in FIG. 3 and 5 is substantially rectangular in configuration, and consists of side frame members 60 interconnected at each corner to depending leg members 62. The lower frame 58 includes side frame members 64 connected as shown in FIG. 2 to the leg members 62 at a position below the frame members 60. The dimension of the frames 56 and 58 are such that the legs 62 converge axially downwardly and inwardly toward the central axis "A".

The motor 46 as shown in FIG. 1 is supported on a pair of elongated cross members 66 which as shown in FIG. 2 and 3 are secured to and supported on the lower frame members 64. The lower end portion of the sleeve 50 is formed to include a flange 68 which as shown in FIG. 1 is supported on and fixed to the members 66. As can readily be understood, the portion of the suspension system 54 (FIG. 5) fixedly secured to the tub 14 and accordingly movable therewith in fact becomes part of the singular movable mass which as will now be explained is supported on the base member 55.

Figure 4:
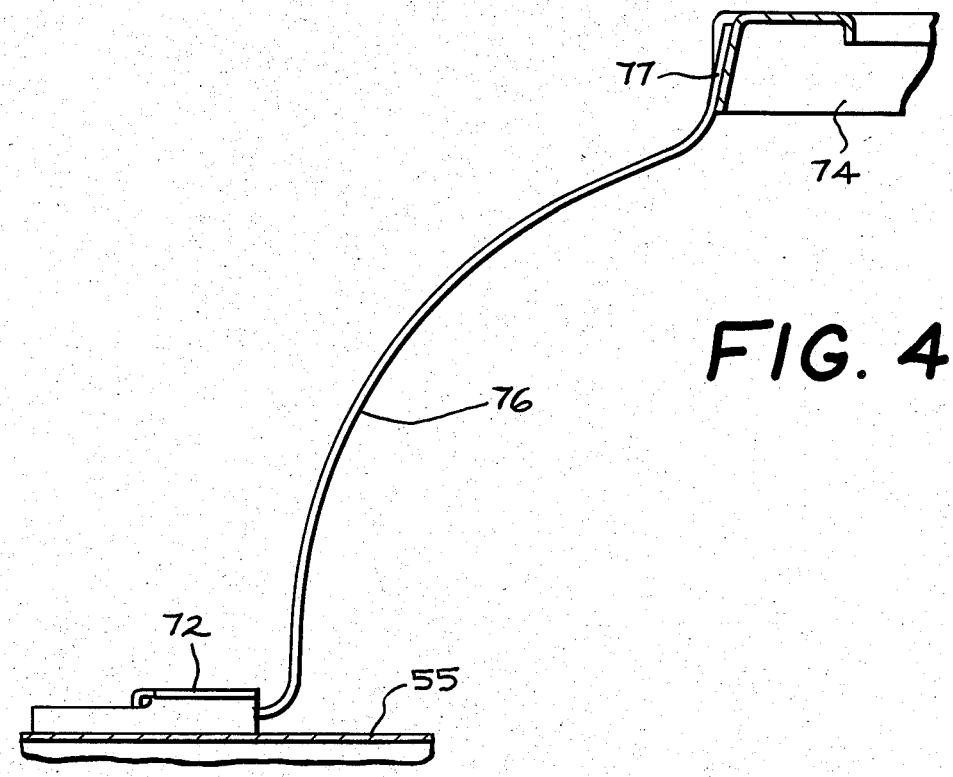
FIG. 4 is an enlarged elevational view taken along line 4—4 of FIG. 3 showing a detail of construction.
Figure 6:
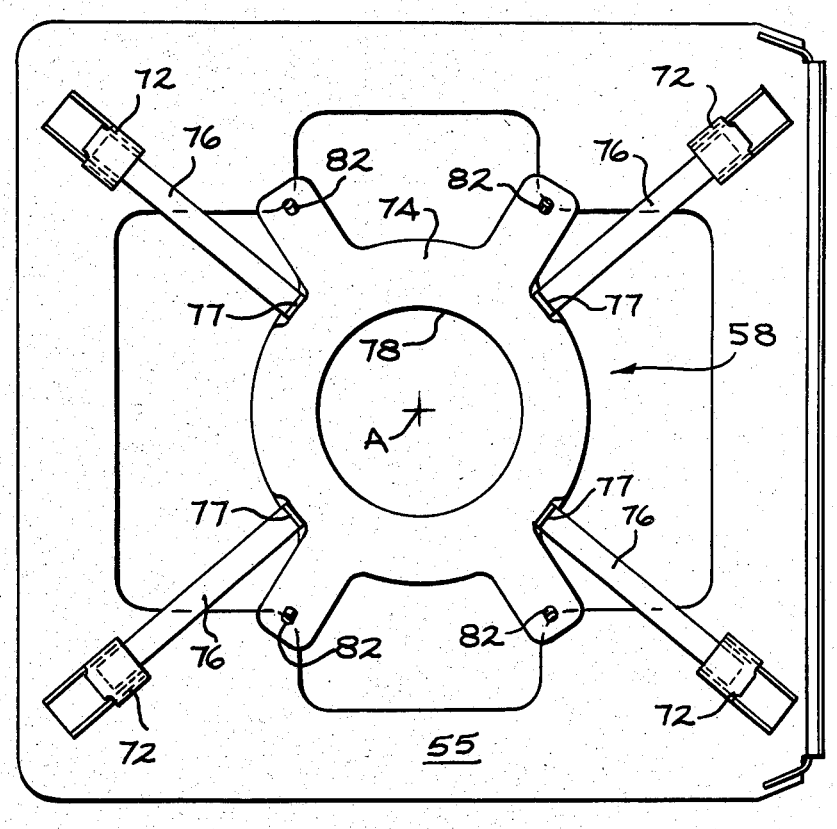
FIG. 6 is a plan view of a portion of the suspension system secured to the base of the machine for supporting the movable mass.

The movable mass is supported on the base 55 through the supporting portion of the suspension system by means of a plate or load support member 74. The support member 74 is mounted on leaf spring legs or straps 76. In the present embodiment there are shown four spring legs each extending inwardly from a position adjacent a corner of the base 55 as shown in FIG. 3 and 6. However, it may be possible under certain parameters to employ any number of spring legs. The spring legs 76 extend upwardly and inwardly from an attachment 72 on the base 55 to an upper end 77 which is secured to the plate 74. An ample generally circular clearance opening 78 in the plate 74 permits the sleeve 50 to depend freely through the plate 74. As best seen in FIG. 4 the upper ends 77 of the springs 76 at the connection to the plate 74 curve toward a vertical orientation. This portion 77 of the spring extending toward vertical adds vertical stiffness to the springs at their upper ends. Further, the position of the springs 76 by extending inwardly from each corner of base 55 toward the central axis "A" offer greater resistance toward movement in the side-to-side direction of the cabinet while offering less resistance in a diagonal direction of the cabinet. Accordingly, a bigger excursion is allowed in the direction toward the corners of the cabinet where there is greater tolerance for movement. The movable mass is supported on the plate 74 above the base 55 as shown in FIG. 2 through a plurality of links 80. The upper ends 82 of the links 80 pass through and are secured to the plate 74, the lower ends 84 of the links 80 are secured to an inwardly bent flange 86 the lower ends of the legs 62 of the chassis 54. As best seen in FIG. 3 and 5, the lower ends of the legs 62 extend radially inwardly from their attachment to the upper frame members 60. This arrangement readily permits the links 80 to, in effect, converge radially inwardly as they extend downwardly from the plate 74 to their connection on legs 62. This selected angle of inclination relative to the axis "A" of the machine provides greater stability of the movable mass and further ensures that the node while movable both horizontally and vertically will always be below the basket. In the present instance four links 80 were employed in carrying out the suspension system. It was determined in carrying out the present invention that the selection of four links provides a parallelogram action between the plate 74 and the movable mass or hanging portion of the system. However, it may be possible under certain design parameters to employ any number of links. Due to the stiffness of the links 80, the parallelogram is maintained between the links and its connecting parts. While the portion of the suspension system connected to the movable mass (FIG. 5) is shown assembled and separate from the portion connected to the base (FIG. 6), it should be understood that because of the interwoven parts they are assembled as a single unit as shown in FIGS. 1–3.

As can be readily understood, horizontal motion of the movable mass is provided by the arrangement of the links 80 while vertical movement of the movable mass is provided through the action of the springs 76. Damping of the movable mass is provided wherein dampers 88 are anchored to the base 55. The dampers 88 as shown in FIG. 1 include a U-shaped spring clamp member 90 resiliently secured to the base member 55 and a pair of friction pads 92. The pair of friction pads 92 are held in engagement with the surface of a plate 94 secured to the legs 62 of the movable mass by the U-shaped spring clamps 90. The spring clamp 90 are relatively strong so that each plate 94 is gripped tightly by the friction pads 92. The damping devices 88 and their action relative to the movable mass as shown are independent of the load and accordingly have a constant clamping characteristic.

The imbalance forces operating on the moving system or mass supported by the load member 74 when the basket is spinning at a relatively high speed cause, basically, two types of vibration motion. Firstly, there is a generally swinging or pendulous motion of the movable mass within a vertical plane. Such pendulous motion causes the link members 80 to pivot at their end portions. By the present arrangement, the pendulous movement of the movable mass tends to become almost a substantially horizontal movement with, very little tilting because of the parallelogram configuration as explained above. The pendulous movement of the mass is thereby seen to be of a self-correcting or self-balancing nature and has a tendency to remain substantially horizontal and thereby enabling the system to support a load wherein the center of gravity will always remain within a vertical cylinder whose diameter is defined by a circle drawn from a radius generated from the central axis and whose circumference passes through the center of the link mounts 82 on the upper plate 74. The second type of motion which may occur is a rocking or oscillating motion about a point wherein the mass tends to rotate relative to the support base 55 in a manner similar to that explained in detail for the aforedescribed pendulous motion, the present system tends to self-correct or self-balance the tilting tendancy of the support member.

The third type of motion which may occur is vertical or axial movement of the mass. Such vertical motion causes the spring support members 76 to flex and thereby to cause the support plate 74 to tilt. The dimension of the spring support members 76 is such that such tilting when it does occur will be slight. This arrangement of spring support members has a self-correcting or self-balancing tendency of the vertical movement on the support member.

It will thus be seen that the present suspension system will accommodate both pendulous and rocking motion. However, almost invariably there is a combination of rocking and pendulous motion. Such a combination of motions, however, poses no additional problem for the present system as the components thereof coact in substantially the same manner to self-correct the effects of either motion or a combination thereof.

The spring support members 76 have desirable flexibility for allowing lateral mobility of the suspended mass as well as sufficient strength for supporting the weight of the mass. This allows the suspension system to provide a substantially solid support for the tub assembly 14 during the agitation cycle and some dampening of forces during a normal spin cycle. These characteristics are desirable because during the washing cycle large forces are created by the oscillatory motion of the agitator against the clothes and the water in the tub 14, and a relatively firm or stable tub support is needed to prevent significant movement or excursion of the tub 14 within the cabinet 12 which might cause damage to the cabinet. The relatively firm or stable base during the agitate cycle is provided in the instant invention by the dimension of the springs when water is added to the tub 14.

However, during the extraction cycle it is best to provide only a limited amount of dampening since, if an unbalance occurs in the basket 16 due to an off balance load, the forces created by the off balance load will be most effectively isolated from the cabinet base 55 by a suspension system with a low dampening co-efficient. Furthermore, a suspension system with a low spring rate generally has a lower natural frequency so that during acceleration of the basket at the start of the extraction cycle, the basket will more quickly pass through the critical speed. The term "critical speed" is the rotational speed of the basket which approximates a natural frequency of the suspended system and this speed may be, for example, about 100 revolutions per minute.

When the basket 16 is rotating at or near a critical speed, the tendency of excursion or orbital movement of the basket, especially a basket carrying an unbalanced load, is substantially increased. As a principal matter, when the spinning basket has passed through the critical speed, excursion of the tub 14 and basket assembly 16 within the cabinet 12 is reduced. Therefore, the continued application of dampening to prevent excursion after the basket has exceeded the critical speed may tend to unnecessarily transfer motion to the cabinet base.

Due to the dimension of the springs 76, as the springs 76 are compressed by the filled tub, the suspension system 54 provides a substantially solid support for the tub assembly during the agitation cycle. However, when the liquid is drained from the tub the system provides a low spring rate for the extraction cycle. Because of the low spring rates which are utilized and which allow relatively free movement of the tub, it is necessary to additionally limit the large excursions of the tub as the spinning basket approaches and passes through the critical speed in order to prevent excessive noise and even damage to the appliance.

The instant suspension system provides for limited excursion of the tub and basket assembly as the basket is accelerated through critical speed during the extraction cycle, and has the desirable feature of increased effectiveness proportionate to the increase of such excursion. During the spinning mode of operation, the suspension system 54 together with the damping devices 88 will have a snubbing effect on any horizontal movement which exceeds a given amount and will selectively dampen vertical excursion during such excessive horizontal movement of the tub and basket assembly.

It should be apparent to those skilled in the art that the embodiment described heretofore is considered to be the presently preferred form of this invention. In accordance with the Patent Statues, changes may be made in the disclosed apparatus and the manner in which it is used without actually departing from the true spirit and scope of this invention.

What is claimed is:

1. In a vertical axis washing machine having a base and further having a movable mass including a rotatable basket and an agitator arranged in said basket, and means for imparting oscillation motion to said agitator and rotational movement to said basket which generates both vertical and horizontal vibration to said movable mass a suspension system for supporting said movable mass above said base, comprising:

a support member; a plurality of circumferentially spaced spring members connected at their lower end to said base and converging therefrom upwardly and radially inwardly with their upper ends connected to said support member;

a frame structure connected to said movable mass including an upper frame portion, and a lower frame portion interconnected by leg members extending between said upper and lower frame portions;

a plurality of circumferentially spaced links extending in the general direction of the vertical axis, each of said links having its upper end connected to said support member and their lower end connected to said lower end of said leg member of said frame structure below said support member to thereby support said movable mass above said base in a manner which absorbs both the vertical and horizontal vibrations of said movable mass.

2. The washing machine recited in claim 1 wherein four spring members are provided spaced circumferentially on said base.

3. The washing machine recited in claim 2 wherein four links are provided spaced circumferentially between said movable mass and said support member.

4. The washing machine recited in claim 3 wherein clamping means are provided between said movable mass and said base.

5. The washing machine recited in claim 4 wherein the upper end portion of said spring members are oriented substantially vertically so as to provide a vertical column adjacent said support member.

6. The vertical axis washing machine recited in claim 1 wherein four spring strap members are provided spaced circumferentially on said base.

7. The washing machine recited in claim 6 wherein said frame structure includes four leg members and four links are provided spaced circumferentially connected between said leg members and said support member.

8. The washing machine recited in claim 7 wherein damping means are provided between said movable mass and said base.

9. The washing machine recited in claim 8 wherein the upper end portion of said spring members are oriented substantially vertically so as to provide a vertical column adjacent said support member.

10. In a vertical axis washing machine having a base and further having a movable mass including a rotatable basket and an agitator arranged in said basket, and means for imparting oscillation movement to said agitator and rotational movement to said basket which generate both vertical and horizontal vibrations to said movable mass, a suspension system for supporting said movable mass and above said base, comprising:

a support member; four spring members spaced circumferentially connected at their lower end to said base and converging therefrom upwardly and radially inwardly with their upper ends connected to said support member;

a frame structure connected to said movable mass including an upper frame portion connected to said tub and a lower frame portion, leg members interconnecting said upper and lower frame portion extending below said support member;

four circumferentially spaced links extending in the general direction of the vertical axis, each of said links having its upper end connected to said support member and their lower end connected to said leg members of said frame structure below said support member to thereby support said movable mass above said base in a manner which absorbs both the vertical and horizontal vibrations of said movable mass.

11. The washing machine recited in claim 10 wherein said links extends radially downwardly and inwardly from said support member to thereby ensure that the node of said movable mass while moving vertically and horizontally remains below said basket.

12. The washing machine recited in claim 11 wherein said base is substantially rectangular and the lower ends of said spring members generate radially inwardly and upwardly from a position adjacent the corners of said base.

13. The washing machine recited in claim 12 wherein damping means are provided between said movable mass and said base.

14. The washing machine recited in claim 13 wherein the upper end portion of said spring members are oriented substantially vertically so as to provide a vertical column adjacent said support member.

* * * * *